US006769552B1

(12) United States Patent
Thalenfeld

(10) Patent No.: US 6,769,552 B1
(45) Date of Patent: Aug. 3, 2004

(54) PRODUCT PUSHER

(75) Inventor: David R. Thalenfeld, Bear Creek, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 10/024,156

(22) Filed: Dec. 17, 2001

(51) Int. Cl.[7] ..... A47F 7/00
(52) U.S. Cl. ..... 211/59.3; 211/189; 211/183
(58) Field of Search ..... 211/59.3, 59.2, 211/51, 183, 74, 175, 184, 189; 221/271, 279; 312/42, 45, 61, 71, 72

(56) References Cited

U.S. PATENT DOCUMENTS

| | | | | | |
|---|---|---|---|---|---|
| 2,738,881 | A | * | 3/1956 | Michel | 211/43 |
| 4,303,162 | A | | 12/1981 | Suttles | |
| 4,830,201 | A | * | 5/1989 | Breslow | 211/184 |
| 4,899,893 | A | | 2/1990 | Robertson | |
| 5,012,936 | A | | 5/1991 | Crum | |
| 5,027,957 | A | * | 7/1991 | Skalski | 211/43 |
| 5,114,021 | A | | 5/1992 | Fredrickson | |
| 5,190,186 | A | * | 3/1993 | Yablans et al. | 221/124 |
| 5,390,802 | A | | 2/1995 | Pappagallo et al. | |
| 5,634,564 | A | * | 6/1997 | Spamer et al. | 211/175 |
| 5,671,851 | A | | 9/1997 | Johnson et al. | |
| 5,730,320 | A | | 3/1998 | David | |
| 5,746,328 | A | | 5/1998 | Beeler et al. | |
| 5,839,588 | A | | 11/1998 | Hawkinson | |
| 5,855,281 | A | | 1/1999 | Rabas | |
| 5,878,895 | A | | 3/1999 | Springs | |
| 5,881,508 | A | * | 3/1999 | Irvine et al. | 52/177 |
| 5,881,910 | A | | 3/1999 | Rein | |
| 5,996,772 | A | * | 12/1999 | Foster | 198/750.3 |
| 6,105,791 | A | * | 8/2000 | Chalson et al. | 211/59.3 |
| 6,129,218 | A | | 10/2000 | Henry et al. | |
| 6,155,437 | A | | 12/2000 | Rassent | |
| 6,155,438 | A | | 12/2000 | Close | |
| 6,409,027 | B1 | * | 6/2002 | Chang et al. | 211/184 |
| 6,484,891 | B2 | * | 11/2002 | Burke | 211/59.3 |

* cited by examiner

*Primary Examiner*—Jennifer E. Novosad
(74) *Attorney, Agent, or Firm*—Schweitzer Cornman Gross & Bondell LLP

(57) ABSTRACT

A product pusher device comprising an elongated guide track and a pusher sled slidably guided along the track for urging product packages forwardly on a display shelf. The pusher sled incorporates a housing for containing a coiled strip spring element. The end extremity of the spring is anchored at the forward end of the guide track, and t he coiled body spring is confined within the housing at the back of the sled. By constructing the sled housing with an open bottom, assembly is greatly facilitated by allowing the spring to be anchored on the guide track independently of the sled and thereafter allowing the sled to be lowered over the coiled body of the spring and pressed downward to be snapped into assembled position on the guide track.

9 Claims, 6 Drawing Sheets

16
26
24
23
38
37
10
38a
41
23
33
40
18
19
30
6
6

FIG. 6a
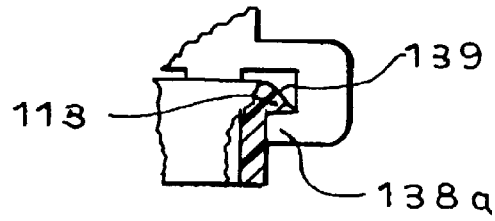
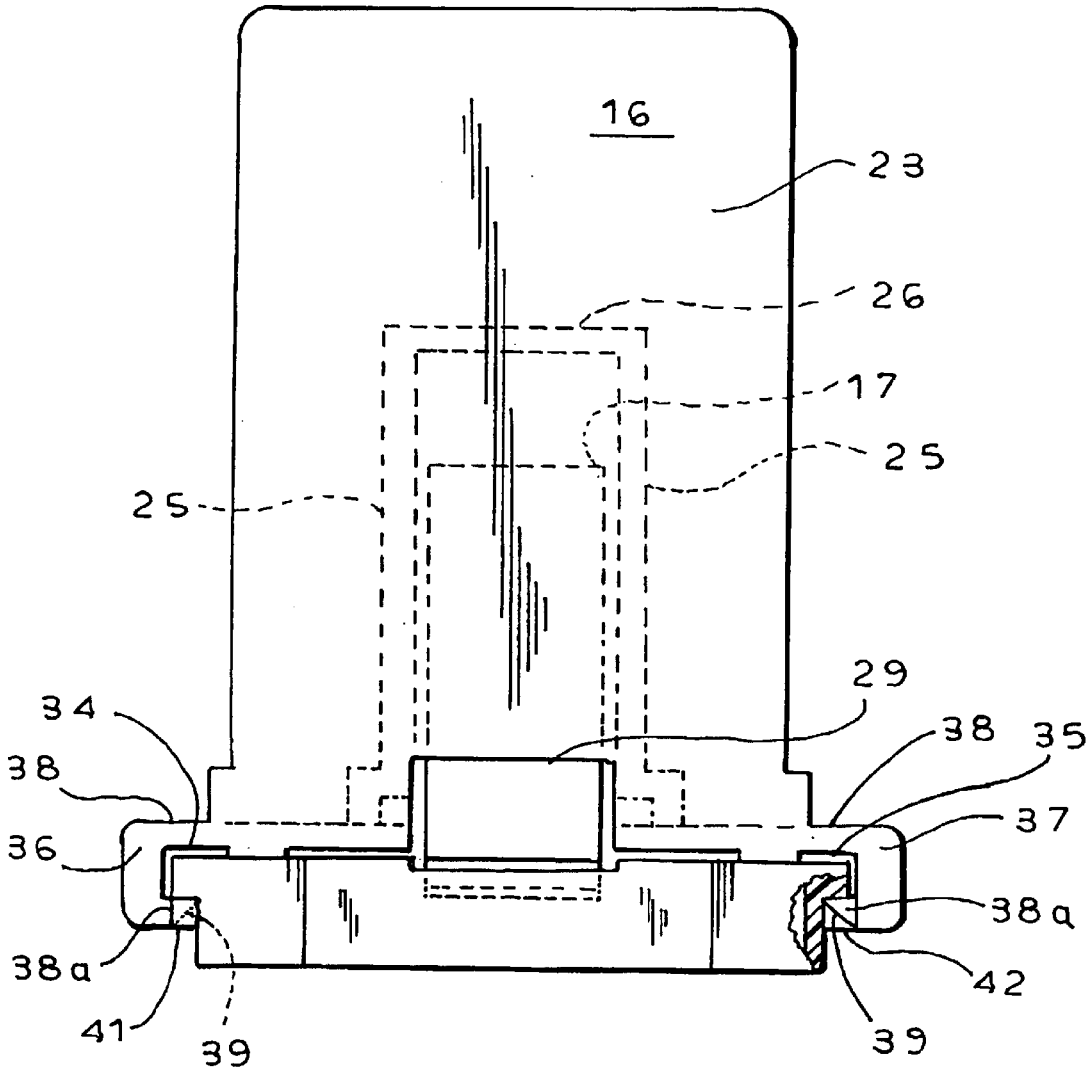
FIG. 6

PRODUCT PUSHER

BACKGROUND OF THE INVENTION

In connection with many product display systems, for the display and presentation of product items on store shelves, it is beneficial to position the product items neatly in line and close to the front of the shelving, for easy viewing and retrieval by the customer. To this end, it is a well known practice to install pusher devices on display shelving, arranged by spring action to constantly urge a line of product items toward the front of the shelf. U.S. Pat. Nos. 5,855,281, 5,012,936 and 4,303,162 are representative of many proposals for this purpose.

A simple and well known type of product pusher utilizes a guide track member and a pusher sled movable along the guide track. A flat strip coil spring is associated with the sled and serves constantly to urge the sled in a direction toward the front of the guide track. A line of product items positioned in front of the sled will be constantly urged toward the front by reason of the spring action on the sled. A fixed stop at the front of the shelf positions the frontmost product item.

Product pushers of the type described in the preceding paragraph are, in general, well known and widely used. The manufacture of such product pushers, however, is more costly than desired, because of handwork involved in the overall assembly of the device.

SUMMARY OF THE INVENTION

The present invention is directed to the provision of a product pusher system along the lines described above which is significantly more advantageous than known devices in that the operations involved in its assembly are greatly simplified and expedited, resulting in significant labor savings in the assembly operations and enabling the new device to be produced at significantly lower cost.

In the assembly of conventional product pushers of the type involved herein, the pusher sled is provided with a chamber, open at the back but otherwise enclosed, for the reception of a coiled strip spring. A narrow slot is formed in the lower front wall portion of the sled through which the outer convolution of the spring is projected. The end extremity of the spring is provided with an offset portion, which is arranged to be inserted through a vertical slot in the guide track to form an anchor for the end extremity of the spring. When assembling the system, the sled is applied to the guide track by applying it over the rearwardmost end of the guide track and sliding it to a front position. The coiled strip spring is then inserted into the open back of the spring chamber provided on the sled, with the assembler manipulating the end extremity of the spring so that it is inserted into and extended through the slot in the lower portion of the sled. The assembler then grips the projecting end extremity of the spring strip with a suitable tool such as pliers, and distorts it as necessary to insert the end downward into the anchor slot in the guide track. Particularly, this last operation requires some strength and dexterity and is a relatively time consuming assembly operation.

Pursuant to the present invention, the design of the sled and guide strip is such that the coiled strip spring may be manipulated entirely independently of the sled, in order to insert the end extremity of the spring into an anchor slot at the front of the guide track. That is a rapid and simple operation, requiring no tools or any special dexterity, since the entire spring may be tilted and manipulated to insert the end through the anchor slot, after which the spring can simply be allowed to fall back on to the surface of the guide track. The pusher sled of the new design is constructed with a spring housing which is completely open along the bottom, and is provided with a front opening for the spring, which is in the form of a downwardly opening notch, rather than a slot. Thus, after the spring has been anchored on the guide strip, the sled may be simply lowered over the top of the spring. Engagement of the sled with the guide track is effected by inclined entry surfaces along the bottom of the sled, which are forced apart as the sled is pressed downwardly, and snapped over the opposite side edges of the guide track to complete the assembly. The entire operation is significantly faster to complete than the conventional series of assembly operations.

In the device of the invention, the guide strip is formed with stop means at both ends for limiting the extreme forward and extreme rearward movements of the sled. In conventional designs, in which the sled is applied over the back end of the guide strip, it is possible to pull the spring-loaded sled off of the back of the guide strip enabling it to snap forwardly in an uncontrolled manner, with possible injury.

For a more complete understanding of the above and other features and advantages of the invention, reference should be made to the following detailed description of a preferred embodiment of the invention, and to the accompanying drawings.

DESCRIPTION OF THE DRAWINGS

FIG. 6 is a front elevational of the pusher device of the invention, with parts broken away at the right side to show features of a retaining flange for guiding the pusher sled.

FIG. 6*a* is a fragmentary cross sectional view of an alternative form of retaining flange and guide track.

DESCRIPTION OF THE REFERRED EMBODIMENT

Figure 1:
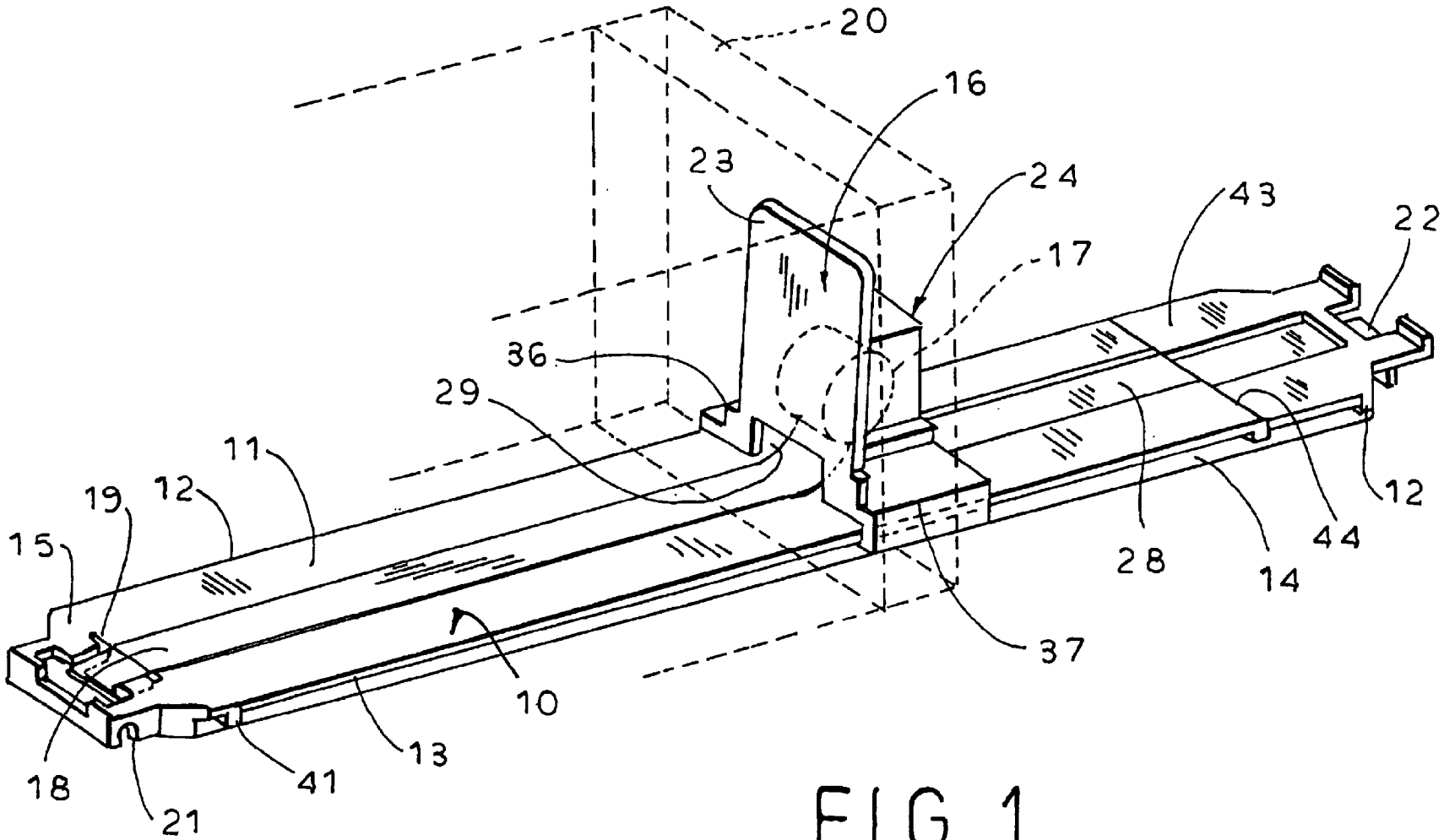
FIG. 1 is a perspective view of a product pusher assembly constructed in accordance with the invention.
Figure 2:
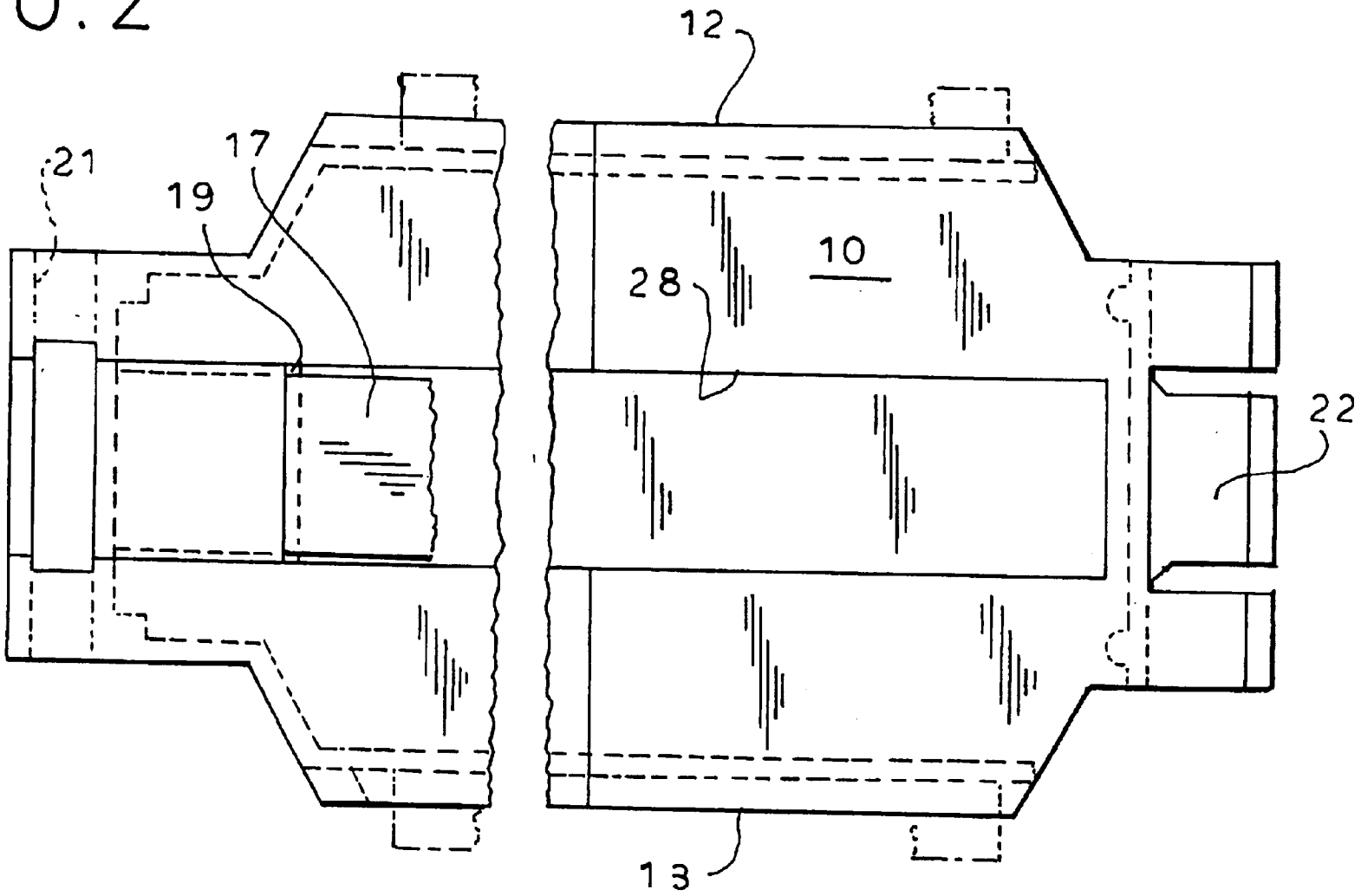
FIG. 2 is a top plan view of a device of FIG. 1, illustrating principally the end extremities of the guide track.

Referring now to the drawing, the reference numeral 10 designates generally a guide track, typically formed of molded plastic material and having a generally flat top surface 11, and spaced apart, parallel guide edges 12, 13 at opposite sides. Stiffening ribs 14 may extend longitudinally to strengthen the guide track. Typically, the guide strip 10 is installed on a product support structure (not shown) which may be a shelf, wire frame or the like. The associated product support means conventionally can include guides (not shown) at each side, and a stop element (not shown) at the front end 15 of the guide track. A pusher sled 16 is slidably mounted on the guide track, being supported on its upper surface 11 and engaging its opposite side edges 12, 13, as generally shown in FIG. 1. A coiled strip spring 17, formed of flat spring steel material wound in a spiral coil, is contained by the pusher sled 16 as will be further described, and the end extremity 18 of the spring is engaged in an anchor slot 19 at the front end of the guide strip. The normal tendency of the spring 17 to recoil itself serves to constantly urge the pusher sled 16 in the back-to-front direction, urging product packages 20 toward the front of the display, all in a generally known manner.

The pusher assembly of the present invention is conveniently and advantageously, but not necessarily, utilized in connection with a wire frame support structure of the general type described in copending application Ser. No. 10/024,153, filed Dec. 17, 2001, owned by Trion Industries, Inc., of Wilkes-Barre, Pa. the assignee of the present invention. To this end, the illustrated form of guide track 10 is provided at the front with a downwardly opening groove 21 and at the rear with a rearwardly opening groove 22. The grooves 21, 22 are arranged for cooperation with transversely disposed support wires (not shown) at each end, allowing the back end of the guide track to be inserted in a rearward direction to engage a wire within the rearwardly opening groove 22, and engaging a wire at the front of the frame by downward movement of the front portion of the guide track to capture a wire within the downwardly facing groove 21. As is described more fully in the indicated copending application, the wire support structure provides the desired lateral guidance and front stop means for product packages being urged in a forward direction by the sled 16.

Figure 4:
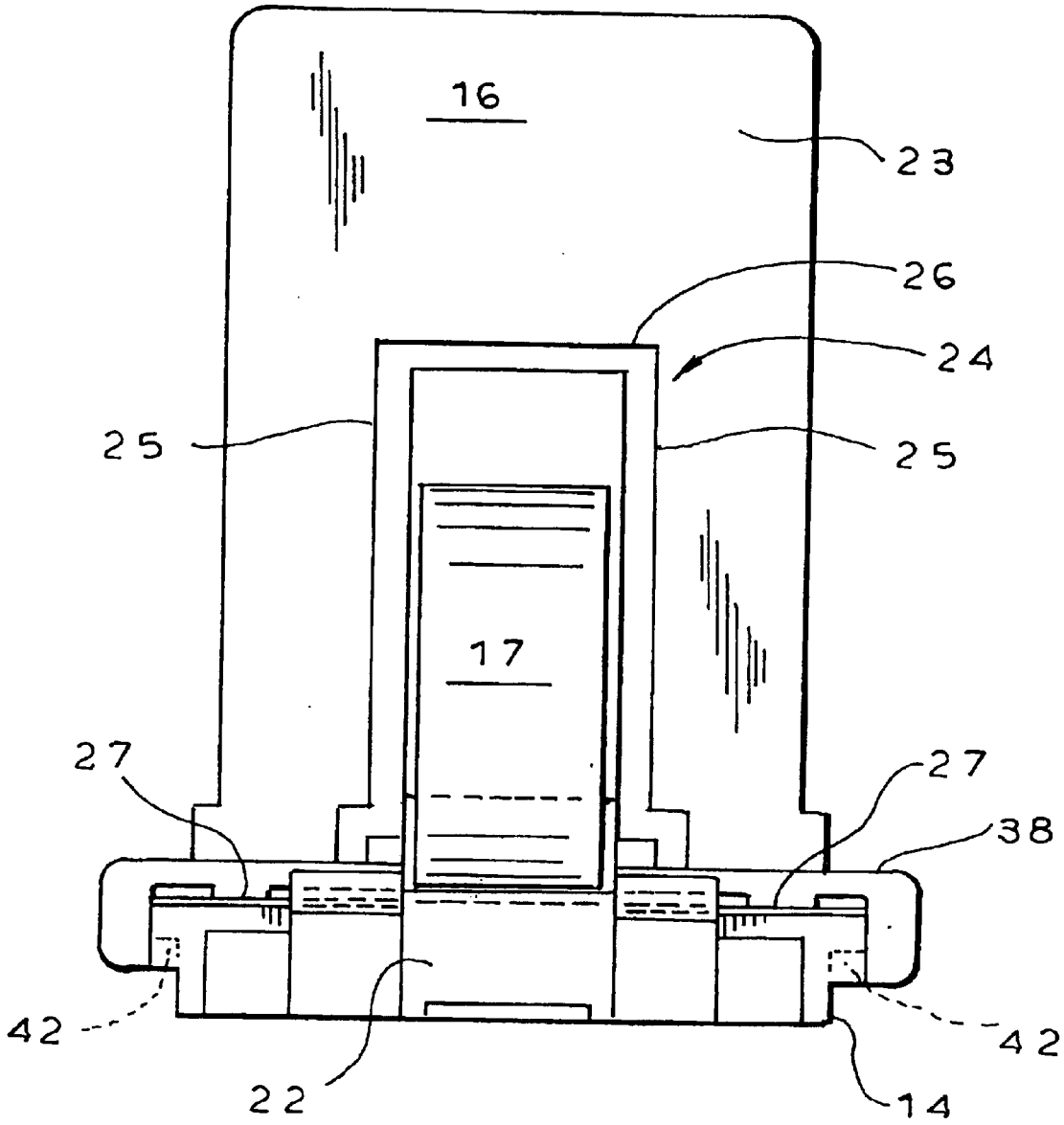
FIG. 4 is a back elevational view of the product pusher device of the invention.

The sled 16, also of molded plastic construction, comprises a generally vertically disposed pusher panel 23 and a rearwardly disposed spring housing 24 comprised of opposed and spaced side walls 25 and a top wall 26. The spring housing 24 is preferably open at the back and, pursuant to the invention, is open at the bottom, as reflected in FIG. 4. A pair of spaced apart, longitudinally extending ribs 27 may be provided along the bottom surface of the sled to minimize contact area and friction with the surface 11 of the guide track. The coiled spring 17 is closely confined, laterally, between the side walls 25 of the spring housing, and the bottom of the spring is supported in a linear recess 28 which extends over the length of the guide track 10, as indicated in FIG. 1. The recess is deep enough to receive the entire thickness of the spring strip material and wide enough to receive the entire width of the spring material, enabling the spring strip to lie below any product packages supported on the guide track 10.

As is evident in FIGS. 1 and 6, the vertical panel 23 of the sled 16 is provided with a downwardly opening notch 29 which directly overlies the linear recess 28 in the guide track and is at least slightly wider than the strip material of the spring 17. The forward end of the coiled spring 17 passes through the spring housing 24 through the notch 29 as the sled 16 is moved forwardly and rearwardly along the guide strip. At its forward extremity, the strip material of the spring 17 is formed with a shallow, L-shaped offset 30, which is engaged through the anchor slot 19 and which serves to anchor the end of the spring strip to the guide track.

By virtue of the tendency of the spring strip to recoil itself, the exposed outer convolution 31 (FIG. 3) of the spring strip bears against the back surface 32 of the pusher panel 23, within the spring housing 24, constantly urging the sled 16 in a forward direction. When free of resistance (or able to overcome resistance), the spring coils itself, sliding over the back surface 32 of the pusher panel, thus moving the sled forward.

Figure 5:
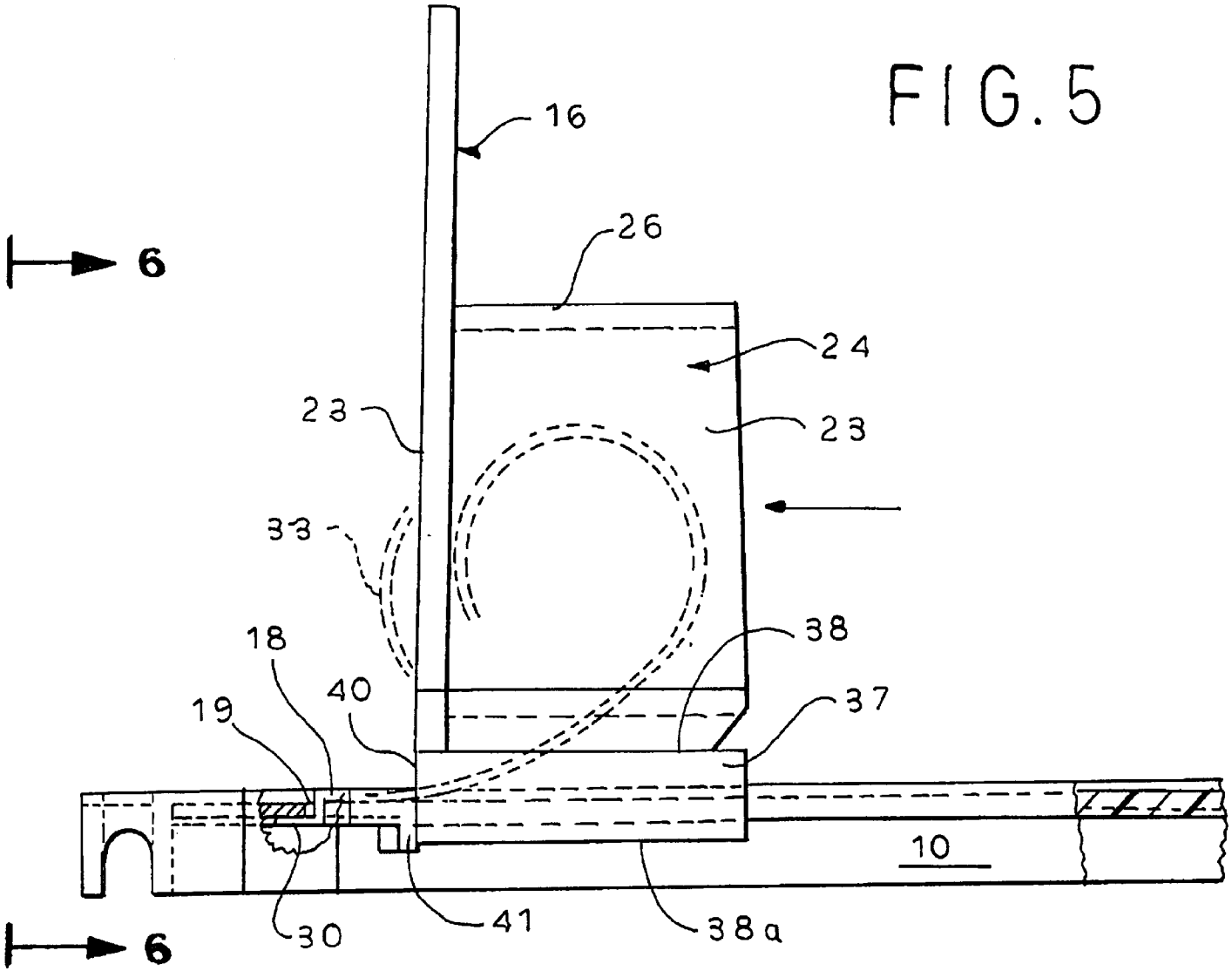
FIG. 5 is a side elevational view of the pusher device of the invention, showing the sled positioned at the forward extremity of the guide track, with parts broken away at the right side to show features of the spring-receiving channel, and parts broken away at the left side to illustrate a locking arrangement for the pusher spring.

Pursuant to the invention, the assembly of the device is initiated by the assembler taking a fully coiled, relaxed coil spring 17 and tilting it upwardly sufficiently to insert the offset end 30 of the spring downwardly through the anchor slot 19. After the offset portion is thus inserted, the body of the spring can be released and allowed to rest in the forward portion of the linear recess 28. As thus installed, the body of the coiled spring 17 will rest a short distance behind the anchor slot 19, with the forward most extremity of its outer convolution being located in a position generally as indicated at 33 in FIG. 5.

After the spring is installed, the sled 16 is lowered over the body of the spring 17 so as to enclose the spring within the housing 24. The forwardly extending portion of the spring strip is located within the downwardly opening notch 29.

Pursuant to the invention, the sled 16 includes opposed guide channels 34, 35 (FIG. 6) formed by side flanges 36, 37 respectively, which are integrally molded elements of the pusher sled 16. Each of the channel-forming flanges 36, 37 is provided with an upper flange section 38, extending laterally outward in cantilever fashion, and a lower flange section 38*a* defining the lower portion of the guide channel 34, 35. The lower flange sections are provided with outwardly and downwardly inclined inner edges 39.

When completing the assembly of the pusher sled 16 to the guide track 10, as the sled is lowered over the coiled spring 17, the sled is moved rearward a short distance, carrying the spring with it and initially tensioning the spring to some degree, until the forward extremities 40 of the channel-forming guide flanges 36, 37 are located at least slightly rearward of a forward abutment stop 41, extending downward from the guide edges 12, 13. The sled 16 may then be pressed downward forcibly onto the guide track. When this is done, the outwardly divergent cam surfaces 39 engage upper corners of the guide edges 12, 13 forcibly displacing the lower flanges 38*a* outward to a sufficient extent to cause them to pass over the guide edges 12, 13 and snap into a locked position, as shown in FIG. 6. The sled 16 can then freely slide back and forth along the guide track 10 in the customary manner.

Because the sled is assembled by being pressed downwardly and snapped over the guide edges 12, 13, rather than being applied over the back end of the guide strip, the guide strip can be and is provided with rear abutment stops 42 which engage the back of the sled as it reaches its rearwardmost position and prevent it from being accidentally pulled entirely off of the guide strip. This is an advantageous safety feature as will be appreciated, because the sled, if pulled entirely off the back of the guide strip, will be under considerable spring tension and, if released, will snap forward with considerable velocity and possibly cause injury.

Figure 3:
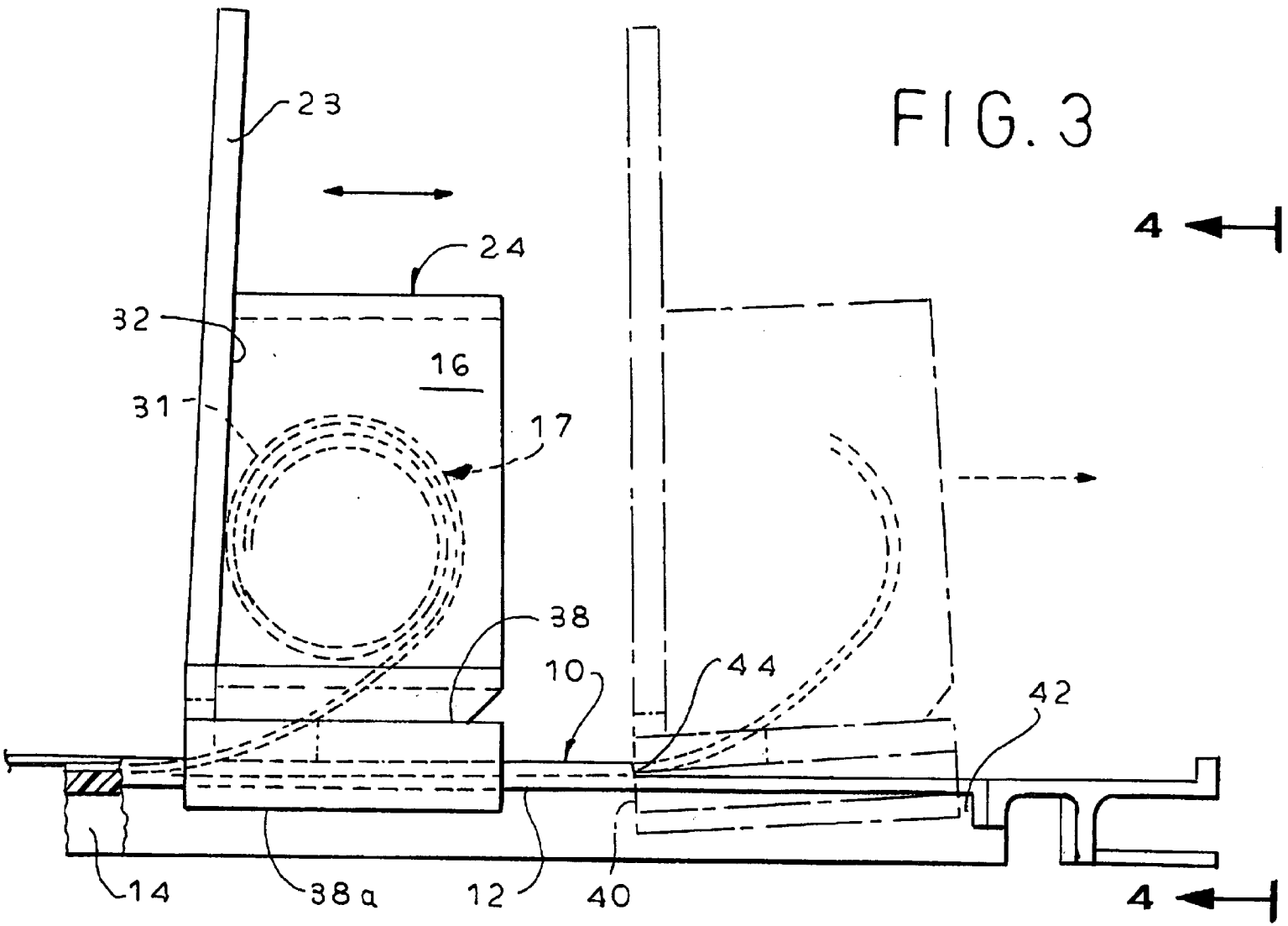
FIG. 3 is a fragmentary side elevational view of the pusher device of the invention, showing the sled positioned adjacent the rearward extremity of the guide track, with parts broken away at the left side to illustrate features of a longitudinal channel for receiving a pusher spring.

To facilitate loading of product items on the pusher system, the guide track 10 advantageously is provided adjacent the back end thereof with a holding notch 43, defining a rearwardly facing stop wall 44. When the sled is moved rearwardly to a position in which the forwardmost surfaces 40 of the channel-forming flanges are behind the stop wall 44, the sled can be tilted downwardly, as shown in FIG. 3, and temporarily locked in a fully retracted position. This allows the store personnel to have both hands free for the loading of merchandise onto the pusher assembly.

In the alternative form of the invention shown in FIG. 6*a*, the lower flange section 138*a* is formed with a square end edge, while the opposite guide edges 112 (not shown) and 113 are formed with upwardly inclined surfaces 139. The operation of the alternative embodiment is substantially the same as for the embodiment of FIG. 6 in that, when the sled is pressed downwardly onto the guide track, the inclined surfaces 139 displace outwardly the lower flanges 138*a*, enabling the sled to be snapped into assembled position on the track by the application of downward pressure.

The pusher assembly of the invention enables significant savings in manufacturing expense by eliminating assembly operations requiring manual dexterity, some degree of strength, and the use of tools. The device of the present invention, utilizing a pusher sled in which a spring housing is formed with an open bottom, allows the spring to be installed entirely independently of the sled, with the sled being lowered over the spring after its installation. Tapered Inclined guide surfaces along the edges of channel-forming flanges of the sled (and/or the edges of the guide track) allow the sled to be forcibly snapped over the edges of the guide track merely by pushing downward. Neither manual dexterity nor tools are required.

Additional advantages are realized from the open bottom configuration of the spring housing. As will be appreciated, when the sled is moving, either forward or backward, along the guide track, the confined spring bears slidingly against rearwardly facing surfaces of the pusher panel 23 which necessarily results in some friction. In prior art constructions, utilizing spring housings with closed bottoms, there is also sliding friction against the bottom panel. The lesser friction inherent in the new construction enables the system to operate more easily and smoothly.

The arrangement for assembly of the sled to the guide track by pressing the sled downward and camming the channel-forming flanges outward in a snap-on procedure enables the guide track to be formed with limit stops at the back of the track to positively prevent accidental removal of the spring-tensioned sled from the back of the track, with an opportunity for the sled to become a projectile.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A product pusher for product displays, which comprises, (a) an elongated guide track formed with spaced-apart parallel, outwardly facing guide edges, (b) a pusher sled positioned on said guide track for sliding movement thereon and having opposed channel-forming flanges slidably engaging said guide edges for guided movement of said sled forwardly and rearwardly along said guide track, said channel-forming flanges having upper portions and lower portions, and said lower portions having inwardly facing edges formed thereon and spaced apart a distance less than a distance between said outwardly facing guide edges, (c) a coiled strip spring having one end extremity anchored at a front portion of said guide track and having a coiled body portion disposed rearwardly of said end extremity, (d) said pusher sled including a pusher element and a spring housing positioned behind said pusher element, (e) said spring housing comprising a pair of spaced apart side elements for lateral confinement of said body portion and a front element for the forward confinement of said body portion, (f) said spring housing having an open bottom through which said coiled body portion can enter said housing during assembly of said pusher sled with said guide track, and (g) the lower portions of the channel-forming flanges of said pusher sled and the guide edges of said guide track being configured such that at least one of said inwardly or outwardly facing edges is formed with inclined edge surfaces positioned to engage oppositely facing edge surfaces of the other of said inwardly or outwardly facing edges during assembly movement of said pusher sled perpendicular to said guide track, whereby the lower portions of said channel-forming flanges and the inwardly facing edges formed thereon are temporarily displaced laterally outward by said outwardly facing edges to accommodate a snap-in assembly of said pusher sled onto said guide track into a locked together relation therewith.

2. A product pusher according to claim 1, wherein (a) the side elements of said spring housing comprise side walls, (b) the front element of said spring housing comprises a portion of said pusher element.

3. A product pusher according to claim 2, wherein (a) said pusher element comprises a generally vertically disposed panel, and (b) the front element of said spring housing comprises a portion of said panel.

4. A product pusher according to claim 3, wherein (a) said panel is provided with a downwardly open notch along a lower edge portion thereof for the forward passage of elements of said spring during forward and rearward movements of said sled relative to said guide track, (b) said notch having a width greater than said spring.

5. A product pusher according to claim 3, wherein (a) said upper portions of said channel-forming flanges extend laterally outward from said spaced-apart side elements in cantilever fashion.

6. A product pusher according to claim 1, wherein (a) said guide track is formed with an anchor slot in a front portion thereof, (b) the end extremity of said spring is formed with an offset portion, and (c) said spring is adapted for installation of said offset portion in said anchor slot prior to assembly of said pusher sled with said guide track, and (d) said pusher sled is adapted for assembly with said guide track after installation of said offset portion in said anchor slot.

7. A product pusher according to claim 1, wherein (a) said guide track is formed with a permanent abutment stop at a rearward end portion thereof to prevent separation of said pusher sled from said guide track by rearward longitudinal movement of said pusher sled and to prevent assembly of said pusher sled onto said guide track from said rearward end thereof.

8. A product pusher according to claim 1, wherein (a) said guide track is formed with a transverse notch in an upper surface portion thereof adjacent a rearward end portion of said track, (b) said transverse notch forming a rearwardly facing stop wall, (c) said stop wall being engageable with forwardly facing surfaces of said pusher sled to temporarily lock said sled in a retracted position.

9. A product pusher according to claim 1, wherein (a) said guide track is formed with a permanent abutment stop at a forward end portion thereof to prevent separation of said pusher sled from said guide track by forward longitudinal movement of said pusher sled and to prevent assembly of said pusher sled onto said guide track from said forward end thereof.

* * * * *